United States Patent [19]

Suzuki et al.

[11] Patent Number: 4,726,740

[45] Date of Patent: Feb. 23, 1988

[54] ROTARY VARIABLE-DELIVERY COMPRESSOR

[75] Inventors: Shinichi Suzuki, Okazaki; Shigeru Suzuki, Nishio; Mitsukane Inagaki, Anjyo; Yasushi Watanabe, Kariya, all of Japan

[73] Assignee: Kabushiki Kaisha Toyoda Jidoshokki Seisakusho, Kariya, Japan

[21] Appl. No.: 765,351

[22] Filed: Aug. 13, 1985

[30] Foreign Application Priority Data

| | | | |
|---|---|---|---|
| Aug. 16, 1984 | [JP] | Japan | 59-171210 |
| Sep. 20, 1984 | [JP] | Japan | 59-197584 |
| Sep. 21, 1984 | [JP] | Japan | 59-199088 |

[51] Int. Cl.[4] ..... F04B 49/00; F04B 49/02

[52] U.S. Cl. ..... 417/295; 417/292; 417/298; 417/310

[58] Field of Search ..... 417/281, 283, 289, 295, 417/302–304, 308–310; 418/78; 417/440, 270, 292

[56] References Cited

U.S. PATENT DOCUMENTS

| | | | |
|---|---|---|---|
| 3,120,814 | 2/1964 | Mueller | 417/310 |
| 3,224,662 | 12/1965 | Oldberg | 417/304 |
| 3,451,614 | 6/1969 | Tosh | 417/440 |
| 4,060,343 | 11/1977 | Newton | 418/78 |
| 4,065,229 | 12/1977 | Black | 417/270 |
| 4,137,018 | 1/1979 | Brucken | 417/440 |
| 4,272,227 | 6/1981 | Woodruff | 417/440 |
| 4,558,993 | 12/1985 | Hori et al. | 417/283 |

*Primary Examiner*—William L. Freeh

*Attorney, Agent, or Firm*—Brooks Haidt Haffner & Delahunty

[57] ABSTRACT

A variable-delivery compressor having plural compression chambers whose volume is changed as a rotor is rotated in a housing to compress a gas sucked through a suction port and deliver the compressed gas through a discharge port, comprising: a by-pass passage for communication between a compressing and a sucking compression chamber of the plural compression chambers; a device for changing the position of the discharge-side extremity of an opening of the by-pass passage on the side of the compressing compression chamber, in the circumferential direction of the rotor, to retard the compression start timing of the compressing compression chamber; and at least one of a variable flow restrictor device associated with a suction passage communicating with the suction port to adjust a flow of the gas which is sucked through the suction passage, and a pressure relief device including a pressure relief passage and a switching device for closing and opening the pressure relief device. The pressure relief passage is normally closed by the switching device, but opened by the switching device to permit the compressing compression chamber to communicate with the suction chamber when the discharge-side extremity of the opening of the by-pass passage is shifted in the rotating direction of the rotor to a position nearest to the discharge port.

6 Claims, 26 Drawing Figures

ROTARY VARIABLE-DELIVERY COMPRESSOR

BACKGROUND OF THE INVENTION

1. Field of the Art

The present invention relates in general to a rotary compressor having a rotor rotated in a housing an a plurality of compression chambers whose volume is changed as the rotor is rotated to compress a gas sucked through a suction port and deliver the compressed gas through a discharge port. More particularly, the invention is concerned with such a rotary compressor of variable delivery type which is capable of reducing its displacement or delivery from the nominal maximum by means of disabling the compression chambers for given periods of time.

2. Related Art Statement

Rotary compressors of the type indicated above are used, for example, as a refrigerant compressor for an air-conditioning system in an automotive vehicle. The compressor is required to provide a large delivery while the air-conditioning system is operated in a mode to lower the room temperature of the vehicle. After the room temperature has been lowered to a comfortable level, the air-conditioning system is switched from the temperature lowering mode to a mode to maintain the room temperature. In the latter mode for maintaining the temperature at a constant level, the compressor is not required to operate at its nominal maximum or full-capacity rating, and should preferably be operated at a reduced capacity rating so as to provide a reduced delivery.

To this end, a rotary compressor is proposed according to U.S. Pat. No. 4,060,343, which uses a rotary plate having a by-pass passage for communication between a compression chamber which is compressing a gas, and a compression chamber which is sucking the gas. In this compressor, upon a decrease in the cooling load applied to the compressor, the rotary plate is rotated as by a hydraulic actuator to shift the position of the discharge-side edge of the opening of the by-pass passage toward the discharge port in the rotating direction of the rotor, in order to retard the timing of starting the compression of the gas in the compression chamber and thereby reduce the delivery of the compressor.

The above proposed arrangement is advantageous in that the compressor is automatically switched to its reduced-delivery mode when the cooling load is reduced below a certain level. However, the proposed compressor suffers some inconveniences that should be solved.

More specifically, the compressor using such a rotary plate for retarding the compression timing of the compression chamber requires the rotary plate to be rotatable by a relatively large angle to obtain a sufficient shifting distance of the discharge-side end position of the by-pass passage for achieving a sufficient degree of reduction in the delivery of the compressed gas. For this reason, the compressor inevitably requires a complicated and large-sized device for actuating the rotary plate.

In view of the above incoveniences, the assigneee of the present application developed a rotary compressor as disclosed in Laid-open Publication No. 59-183098 of Japanese Patent Application No. 58-58846 (filed in 1983), which uses a closure member which is movable between a first position in which the closure member fills a portion of a suction port on the side nearer to a discharge port in the rotating direction of the rotor (hereinafter simple called "discharge-side" portion of the suction port), and a second position in which the discharge-side portion of the suction port is not occupied by the closure member. When the cooling load is reduced, the closure member is moved to its second position to shift the discharge-side edge or end of the suction port toward the discharge port, and thereby retard the compression start timing of the compression chamber. Thus, the delivery of the compressor is reduced.

In the rotary compressor disclosed in the above-identified Japanese Patent Application, a comparatively small movement of the closure member permits a comparatively large shift of the discharge-side end or extremity of the suction port. Hence, the arrangement in question has eliminated the previously indicated problem associated with the rotary plate. That is, the actuator for the rotary plate tends to be complicated and large-sized. Nevertheless, the arrangement using the closure member has the following problem.

In the case that the start of compression of the gas in the compression chamber is retarded by changing the position of the discharge-side extremity of the suction port, the gas once sucked into the leading compression chamber is difficult to be discharged into a suction chamber or difficult to flow into the flowing compression chamber which is sucking the gas, while the compresser speed and the inertia of the gas are relatively high. In such conditions, it is difficult to expect a sufficient degree of reduction in the compressor delivery.

Another form of variable-delivery rotary compressor is proposed according to Laid-open Publication No. 59-99089 of Japanese Patent Application No. 57-209016 (filed in 1982), wherein a spool valve is provided in a suction passage communicating with a compression chamber in a sucking process (sucking compression chamber). In this compressor, the effective area of suction of the suction passage is reduced by the spool valve to reduce the compressor delivery when the cooling load is lowered.

Although the above arrangement permits sufficient reduction of the compressor delivery during a high-speed operation of the compressor, the reduction of the suction area of the suction passage may not result in sufficient delivery reduction while the compressor speed is low, because a large amount of gas may be sucked into the compression chamber through the suction passage even when the suction area is reduced while the compressor speed is low. Further, the instant proposed arrangement using the spool valve is less effective in preventing the compression of a fluid (e.g., refrigerant) in the liquid state and an abrupt increase in the engine load of the vehicle upon starting the compressor, as compared with the previously indicated arrangement wherein the position of the discharge-side end of the suction port is shifted.

In conclusion, none of the aforementioned rotary compressors known in the art is capable of effecting a sufficient degree of reduction in its delivery over the entire range of operating speed.

SUMMARY OF THE INVENTION

It is therefore an object of the present invention to provide a rotary compressor operable in a relatively wide speed range, which is capable of achieving a sufficient degree of reduction in its delivery, over the entire speed range.

According to the present invention, there is provided a variable-delivery compressor having a rotor rotatable in a housing and a plurality of compression chambers whose volume is changed as the rotor is rotated to compress a gas sucked from a suction chamber through a suction port and deliver the compressed gas through a discharge port, comprising: a by-pass passage for communication between a compressing compression chamber of the compression chambers which is compressing the gas, and a sucking compression chamber of the compression chambers which is sucking the gas; a by-pass position changing device for changing the position of one of opposite extremities of an opening of the by-pass passage on the side of the compressing compression chamber, which one extremity of the opening is located nearer to the discharge port than the other of the opposite extremities in the rotating direction of the rotor, the by-pass position changing device cooperating with the by-pass passage to constitute a compression timing retarding device for retarding a timing at which effective compression of the gas is started in the compressing compression chamber; and at least one of (a) a variable flow restrictor device associated with a suction passage communicating with the suction port, to adjust a flow of the gas which is sucked through the suction passage, and (b) a pressure relief device including a pressure relief passage and a switching device for closing and opening the pressure relief passage.

The pressure relief passage of the pressure relief device is normally closed by the switching device. When the above-indicated one extremity of the opening of the by-pass passage is shifted in the rotating direction to a position nearest to the discharge port, the pressure relief passage is opened by the switching device for permitting the compressing compression chamber to communicate with the suction chamber, at a postion which is nearer to the discharge port than the above-indicated one extremity of the opening of the by-pass passage in the rotating direction, thereby releasing a portion of the gas from the compressing compression chamber into the suction chamber. An opening of the pressure relief passage on the side of the compressing compression chamber is dimensioned so as not to allow the compressing compression chamber to communicate with the sucking compression chamber through the opening of the pressure relief passage.

In the variable-delivery compressor constructed according to the present invention as described above, the compressor delivery is reduced by (1) retarding the compression start timing of the compressing compression chamber by shifting the discharge-side extremity of the opening of the by-pass passage toward the discharge port in the direction of rotation of the rotor, by means of the by-pass position changing device, and by at least one of the following two additional features: (2) reducing the flow of the gas to be sucked through the suction passage, by means of the variable flow restrictor device; and (3) releasing the compressed gas from the compressing compressing chamber into the suction chamber through the pressure relief passage which is opened by the switching device of the pressure relief device. The reduction in the suction flow of the gas by the variable flow restrictor device is effective for reducing the compressor delivery, particularly when the compressor speed is relatively high. On the other hand, the retardation of the compression start timing by shifting the discharge-side extremity of the opening of the by-pass passage has a large effect on the reduction of the compressor delivery, particularly when the compressor is operated at a relatively low speed. Further, releasing the compressed gas through the pressure relief passage into the suction chamber is effective for reducing the compressor delivery, particularly when the compressor speed is relatively low. After the pressure relief passage has been opened, the compressor may be operated at its minimum capcity rating without shifting the discharge-side extremity of the by-pass passage toward the discharge port. Therefore, the required amount of shifting the discharge-side extremity of the by-pass passage opening in the rotating direction of the rotor may be minimized. In the condition where the discharge-side extremity of the by-pass passage opening is shifted toward the discharge port while the pressure relief passage is closed, the compressor is operated at the intermediate capacity rating.

As is apparent from the foregoing description, it is ideal to provide both of the additional features (2) and (3), i.e., both the variable flow restrictor device for reducing the suction flow of the gas and the pressure relief device for releasing the compressed gas from the compressing compression chamber, in addition to the compression timing retarding device for retarding the compression start timing by means of shifting the discharge-side extremity of the by-pass passage opening toward the discharge port. However, the object of the invention may be attained even if only one of the flow restrictor device and the pressure relief device is provided in combination with the by-pass position changing device. When the variable flow restrictor device is provided, its high delivery reducing effect during a high-speed operation of the compressor is suitably combined with the high delivery reducing effect of the compression timing retarding device during a low-speed operation of the compressor. When the pressure relief device is provided, a pressure release from the compressing compression chamber during a high-speed operation of the compressor may supplement a relatively low delivery-reducing effect of the compression timing retarding device while the compressor speed is relatively high, thereby enabling the compressor to reduce its delivery, as needed, over the entire speed range.

BRIEF DESCRIPTION OF THE DRAWING

The above and other objects, features and advantages of the present invention will be better understood from reading the following detailed description of preferred embodiments of the invention, when considered in connection with the accompanying drawing, in which.

DETAILED DESCRIPTION OF THE PREFERRED EMBODIMENTS

With reference to the accompanying drawing, there will be described in detail several preferred embodiments of the present invention in the form of refrigerant compressors of vane type for use in an air-conditioning system for an automotive vehicle.

Figure 1:
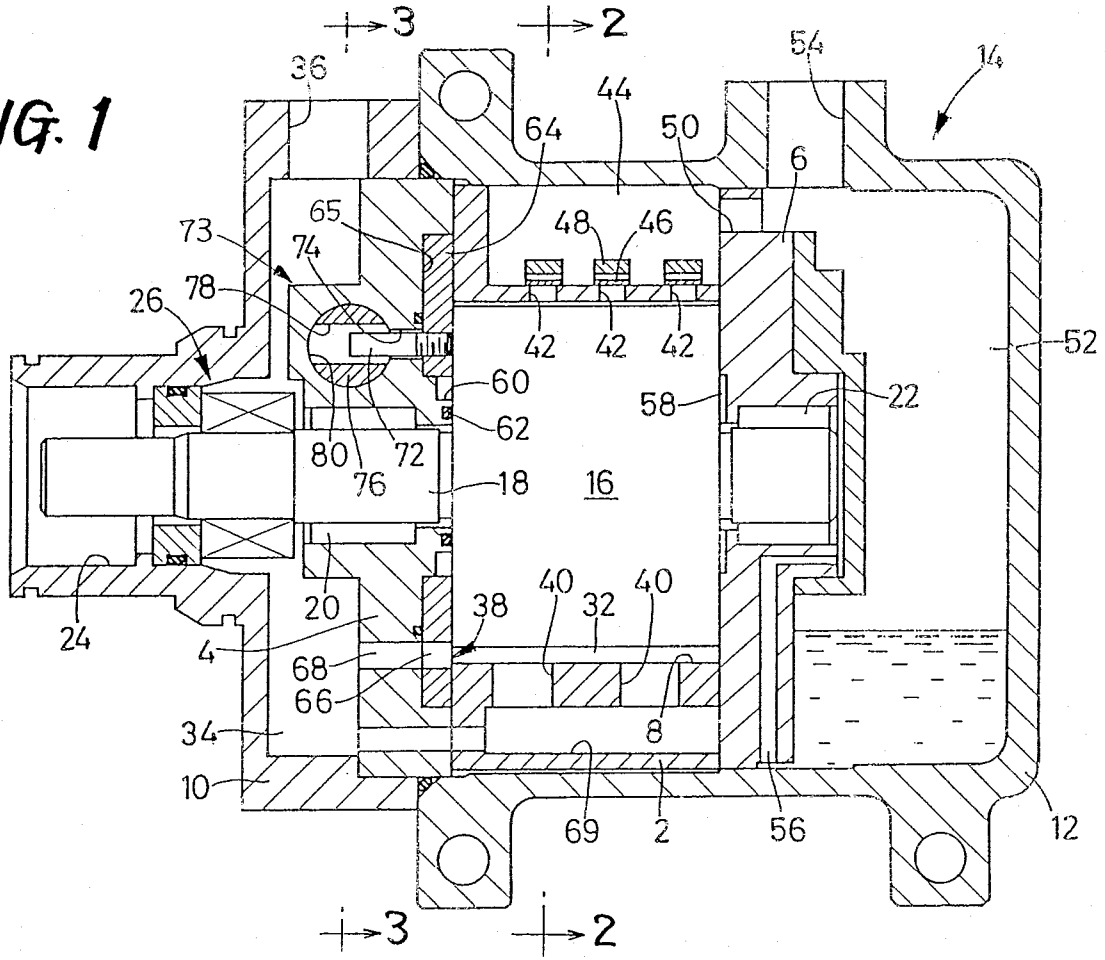
FIG. 1 is an elevational view in longitudinal cross section of one embodiment of a rotary refrigerant compressor of vane type of the present invention.

Referring first to FIG. 1, a reference numeral 2 designates a cylinder of tubular shape whose opposite axial open ends are closed by a front and a rear side plate 4, 6, respectively. The cylinder 2 and the side plates 4, 6 define a rotor chamber 8 having an oval or elliptical shape in transverse cross section. The assembly of these three members 2, 4, 6 is enclosed by a front and a rear housing 10, 12. The housings 10, 12, the cylinder 2 and the side plates 4, 6 are bolted together into an integral housing 14.

The rotor chamber 8 accommodates a rotor 16 of a circular transverse cross sectional shape such that the periphery of the rotor 16 is almost in contact with an inner elliptical surface of the rotor chamber 8 at two opposite points on the minor axis of the ellipse of the chamber 8. Front and rear parts of a drive shaft 18 extend from the centers of opposite axial ends of the rotor 16. The drive shaft 18 is rotatably supported at its front and rear parts by a front and a rear bearing 20, 22 which are fixed in the corresponding front and rear side plates 4, 6. The front part of the drive shaft 18 further extends into a center hole 24 formed in the radially central part of the front housing 10. A sealing device 26 is provided to secure fluid tightness between the front housing 10 and the drive shaft 18.

Figure 2:
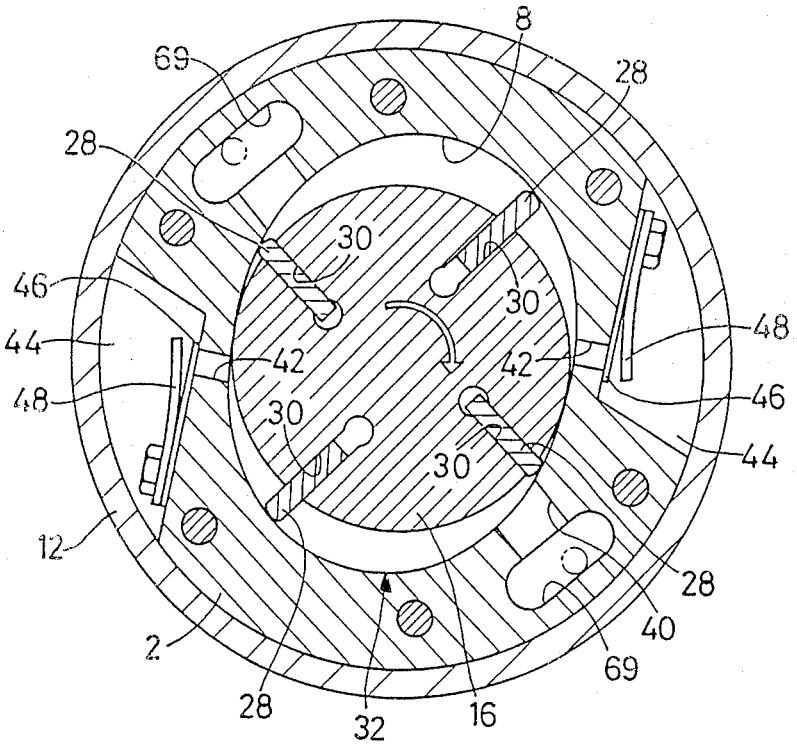
FIGS. 2 and 3 are transverse cross sectional views taken along lines 2—2 and 3—3 of FIG. 1.

As shown in FIG. 2, the rotor 16 has four vane slots 30 in which are received corresponding four vanes 28. The vanes 28 are slidable in the slots 30 such that their outer ends are projected out of the slots 30 toward the inner elliptical surface of the cylinder 2 and are retracted back into the slots 30, while the rotor 16 is rotated. As will be described, the vanes 28 are adapted to be forced, at their outer ends, against the inner elliptical surface of the cylinder 2 with a force of a lubricant oil. Consequently, plural fluid-tight compression chambers 32 are defined by the adjacent vanes 28, outer peripheral surface of the rotor 16, inner elliptical surface of the cylinder 2 and inner surfaces of the front and rear side plates 4, 6, such that the compression chambers 32 are located symmetrically with respect to the axis of the rotor 16. With the rotor 16 rotated by the drive shaft 18 in a direction indicated by an arrow in FIG. 2, the volume of each compression chamber 32 is first increased and then reduced.

Referring back to FIG. 1, a suction chamber 34 is formed by the front side plate 4 and the front housing 10, and a refrigerant inlet 36 is formed in the front housing 10. The refrigerant inlet 36 and the suction chamber 34 communicate with each other so that a refrigerant gas which enters the inlet 36 may be sucked into the suction chamber 34. Further, a primary suction port 38 and auxiliary suction ports 40 are formed so that the refrigerant in the suction chamber 34 may be introduced through these suction ports 38, 40 into the compression chamber 32 whose volume is currently increasing. The primary and auxiliary suction ports 38, 40 are open in the rotor chamber 8 at positions which are spaced short distances in the rotating direction of the rotor 16 away from the points of the inner elliptical surface of the cylinder 2 at which the peripheral surface of the rotor 16 is nearest to the elliptical surface of the cylinder 2.

The refrigerant which has been compressed as a result of a decrease in the volume of the compression chambers 32, is discharged into a discharge chamber 44 through plural discharge ports 42 formed in the cylinder 2. These discharge ports 42 are open in the rotor chamber 8 at positions which are spaced a short distance away from the above-identified points in the direction opposite to the rotating direction of the rotor 16. The discharge chamber 44 is defined by a recess formed in the cylinder 2, and the inner surface of the rear housing 12. Within this discharge chamber 44, there are provided plural sets of a discharge reed valve 46 and an adjusting member 48, which plural sets correspond to the discharge ports 42. The adjusting member 48 restricts a lift amount of the reed valve 46. The refrigerant discharged into the discharge chamber 44 is fed through a communication hole 50 in the rear side plate 6, into an oil separator chamber 52 formed in the rear housing 12. In the separator chamber 52, a mist of oil contained in the refrigerant is separated from the refrigerant. The refrigerant in the separator chamber 52 is then fed to a cooling circuit of the air-conditioning system of the vehicle, through a refrigerant outlet 54 formed in the rear housing 12.

The oil which has been separated from the refrigerant in the oil separator chamber 52 is reserved in its lower part, and fed to the previously indicated bearing 22 through an oil passage 56 formed in the rear side plate 6. Further, the rear side plate 6 has an annular oil groove 58 while the front side plate 4 has an oil groove 60. The oil in the separator chamber 52 is distributed, through the annular oil groove 58 and oil groove 60, to lubricate the mating surfaces of the rotor 16 and vanes 28 and the front and rear side plates 4, 6, and fed into the vane slots 30 so that the oil in the inner end portions of the slots 30 will function to push the corresponding vanes 28 toward the inner elliptical surface of the cylinder 2 defining the rotor chamber 8. A reference numeral 62 indicates an O-ring.

Between the cylinder 2 and the front side plate 4, there is disposed an annular rotary plate 64 which is fitted in a shallow annular groove 65 formed in the front side plate 4 in communication with the the previously described oil groove 60. The rotary plate 64 is supported in the annular groove 65 rotatably about the axis of the cylinder 2 by a limited angle, such that the inner surface of the rotary plate 64 remote from the bottom of the annular groove 65 cooperates with the inner surface of the front side plate 4 to form a continuous planar surface which contacts or is located very close to the corresponding end surfaces of the rotor 16 and vanes 28.

The rotary plate 64 has two first holes, also referred to as rotary plate holes, or movable member relief holes, 66 which are formed through its thickness and disposed symmtically with each other with respect to its axis of rotation. Similarly, the front side plate 4 has two second holes, also referred to as side plate holes, stationary member relief holes, 68 which are formed through its thickness and disposed symmetrically with each other with respect to the rotation axis of the rotary plate 64. Each second hole 68 is located so that it communicates with the corresponding first hole 66. The first and second holes 66, 68 cooperate to constitute a primary suction passage communicating with the suction chamber 34 and the compression chambers 32. The open end portion of each first hole 66 on the side of the compression chamber 32 serves as the primary suction port 38 previously described. Further, two auxiliary suction passages 69 are formed in the front side plate 4 and cylinder 2. The auxiliary suction passages 69 communicate with the auxiliary suction ports 40 and therefore with the compression chambers 32 whose volume is currently increasing. Each of the above-indicated first holes 66 is provided in the form of an arcuate shape along the periphery of the rotor 16, and has a length which is sufficiently greater than the thickness of the vanes 28. The first holes 66 functions as a by-pass passage which permits communication between the leading compression chamber 32 (which is currently compressing the refrigerant: referred to as a "compressing compression chamber" where appropriate) and the trailing compression chamber 32 (which is sucking the refrigerant: referred to as a "sucking compression chamber" where appropriate). The second holes 68 have the same shape and size as the first holes 66.

Figure 3:
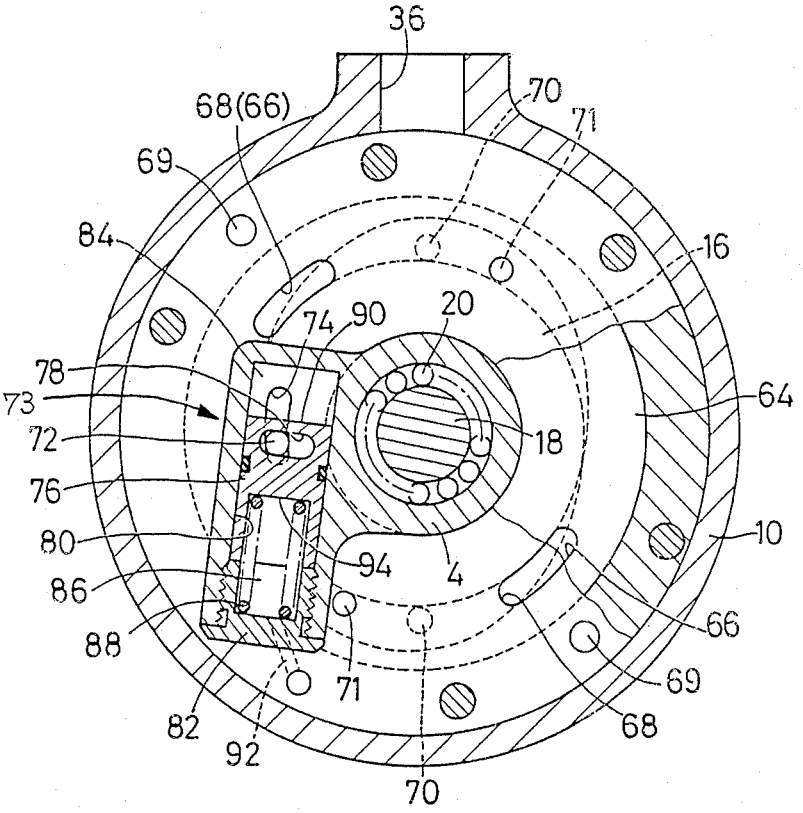
Figure 8:
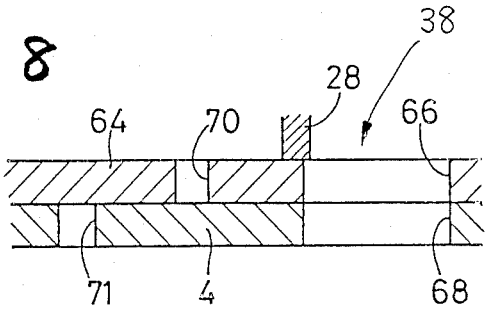
FIGS. 8, 9 and 10 are schematic fragmentary views in longitudinal cross section, corresponding to FIGS. 5, 6 and 7, respectively, showing different operating positions of a rotary plate.
Figure 9:
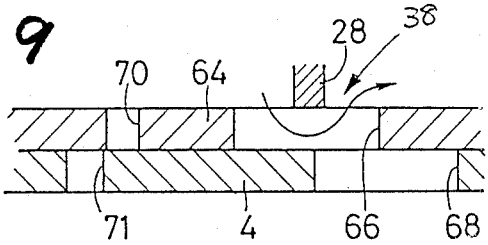

As shown in FIG. 3, the rotary plate 64 further has two first relief holes, also referred to as rotary plate relief holes, or movable member holes, 70 which are formed through its thickness and located between the first holes 66 and the discharge ports 42, as viewed in the direction of rotation of the rotor 16. The diameter of the first relief holes 70 is selected so that the holes 70 may be closed by the lateral end of each vane 28, and is therefore smaller than the length of the first holes 66. In the meantime, the front side plate 4 has two second relief holes also referred to as side plate relief holes, or stationary member holes, 71 which are formed through its thickness and located between the second holes 68 and the discharge ports 42, as viewed in the direction of rotation of the rotor 16. The second relief holes 71 have the same diameter as the first relief holes 70. Normally, each first relief hole 70 of the rotary plate 64 is located between the second hole 68 and second relief hole 71 of the front side plate 4, i.e., closed by the front side plate 4, and thus held disconnected from the second relief holes 71, as shown in FIGS. 8 and 9. As a result of a rotary movement of the rotary plate 64, however, the first and second relief holes 70 and 71 may be brought into communication with each other, thereby effecting communication between the suction chamber 34, and the compressing compression chambers 32. Thus, the first and second relief holes 70, 71 constitute a pressure-relief passage.

As indicated in FIG. 1, the rotary plate 64 is rotated by a reciprocating-piston actuator 73. More specifically, the rotary plate 64 is provided with an engaging portion in the form of a pin 72 fixed thereto such that the pin 72 extends in a direction away from the rotor 16. The pin 72 extends through an arcuate hole 74 formed in the front side plate 4, and is loosely fitted in an elongate hole 78 formed in a piston 76 which is received in a piston chamber 80 formed in the front side plate 4.

As seen in FIG. 3, the piston chamber 80 is formed in a central embossed portion of the front side plate 4 at which the front part of the drive shaft 18 is rotatably supported. More specifically, the embossed portion serves as a cylinder housing which has a round hole closed at one end by a bottom wall adjacent to the center of the side plate 4, and closed at the other end by a closure member 82 to define the piston chamber 80. The piston 76 is slidable in the piston chamber 80 in a tangential direction of the rotary plate 64, that is, in a direction tangent to a circular path taken by the pin 72 when the rotary plate 64 is rotated. The iston chamber 80 is separated by the piston 76 into a first chamber 84 on one side of the piston 76, and a second chamber 86 on the other side of the piston 76. The piston 76 is biased toward the first chamber 84 by a pre-compressed spring 88.

The oil reserved in the lower part of the oil separator chamber 52 is fed to the first chamber 85 through the oil passage 56, bearing 22, oil groove 58, vane slots 30, oil groove 60, annular groove 65 and the arcuate hole 74, as seen in FIG. 1. Since the oil is fed through these relatively narrow passages with a certain degree of flow restriction, and since the oil leaks to some extent in the course of flow to the first chamber 84, the pressure of the oil is lowered to a suitable level (e.g., the oil pressure of 15 $kg/cm^2$ corresponding to the discharge pressure of the refrigerant in the chamber 52 is reduced to about 10 $kg/cm^2$ in the first chamber 84). The oil pressure in the first chamber 84 acts on a first pressure-receiving surface 90 of the piston 76, in the direction toward the second chamber 86.

In the meantime, the second chamer 86 is held in communication with the compressing compression chamber 32, through a communication passage 92 formed in the front side plate 4 and cylinder 2. Accordingly, the pressure of the refrigerant which is under compression in the compression chamber 32 is applied to the second chamber 86 through the communication passage 92, and acts on a second pressure-receiving surface 94 of the piston 76 in the direction toward the first chamber 84.

Figure 4:
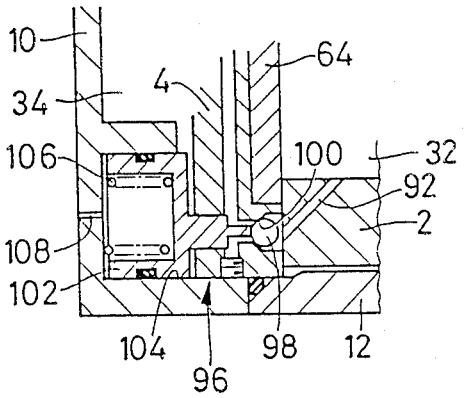
FIG. 4 is a fragmentary view in cross section of the compressor of FIG. 1.

A switch valve 96 is provided in association with the communication passage 92, as illustrated in FIG. 4. The switch valve 96 comprises a spherical valve member 98 adapted to receive the pressure of the refrigerant under compression, a valve seat 100 cooperating with the valve member 98 to close the communication passage 92, and a piston 102 which normally permits the valve member 98 to be seated on the valve seat 100, but advances to push the valve member 98 away from the valve seat 100 when the refrigerant pressure in the suction chamber 34 is lowered below a preset lower limit. The piston 102 is slidably and fluid-tightly received in a piston chamber 104 which is open in the suction chamber 34, and is biased by a spring 106 in the direction that will cause the piston 102 to be moved away from the valve seat 100. The piston 102 receives the atmospheric pressure via a passage 108 formed in the front housing 10, which atmospheric pressure acts on the piston 102 in the same direction as the biasing direction of the spring 106. In the meantime, the refrigerant pressure in the suction chamber 34 acts on the piston 102 in the direction opposite to the biasing direction of the spring 106.

When the switch valve 96 is in its closed position closing the communication passage 92 and the piston 76 is held in the position of FIG. 3 with the oil pressure acting on the first pressure-receiving surface 90 while overcoming the biasing force of the spring 88, the rotary plate 64 is placed in a position in which the first holes 66 in the rotary plate 64 are completely aligned with the second holes 68 in the front side plate 4. In this position, the area of communication between the first and second holes 66, 68 is maximum, and the distance between the first and second relief holes 70, 71 is maximum. When the switch valve 96 is moved to its open position to open the communication passage 92, the pressure of the refrigerant under compression in the compression chamber 32 is applied to the second chamber 86 and the piston 76 is moved toward the first chamber 84. With the movement of the piston 76 toward the first chamber 84, the rotary plate 64 is rotated by a small angle in the clockwise direction in FIG. 3, by means of engagement of the pin 72 with the elongate hole 78, whereby the first holes 66 are shifted relative to the second holes 68, in the direction toward the discharge ports 42. More precisely, the edge or extremity of each first hole 66 on the side of the discharge ports 42 in the rotating direction of the rotor 16 is shifted toward the discharge ports 42. As a result, the area of communication between the first and second holes 66, 68 is reduced, and at the same time each first relief hole 70 is moved toward the corresponding second relief hole 71. With the rotary plate 64 rotated the maximum angle, the first relief hole 70 is brought into full communication with the second relief hole 71.

As will be apparent from the foregoing desciption, the piston 76 engaging the pin 72 of the rotary plate 64 constitutes a major part of the reciprocating-piston actuator 73 which cooperates with the switch valve 96 of FIG. 4 to constitute a rotary-plate actuator device for rotating the rotary plate 64. This rotary-plate actuator device and the rotary plate 64 cooperate to constitute a by-pass position changing device for changing or shifting the position of the discharge-side edge or extremity of the opening of the by-pass passage in the form of the first holes 66. As will be understood from the following description, the by-pass position changing device serves as a compression timing retarding device. In addition, the by-pass position changing device, the rotary plate 64 and the front side plate 4 having the second holes 68, cooperate to form a variable flow-restrictor device for restricting a flow of the refrigerant from the suction chamber 34 into the compression chamber 32. Further, the rotary-plate actuator device functions as a switching device for opening and closing the pressure-relief passage in the form of the first and second relief holes 70, 71, that is, for selective communication between the first and second relief holes 70 and 71. The rotary plate 64 having the first relief holes 70, the front side plate 4 having the second relief holes 71, and the switching device constitute a pressure-relief device for releasing the refrigerant pressure in the compressing compression chamber 32.

There will be described the operation of the vane type rotary refrigerant compressor which is constructed as described hitherto.

Figure 5:
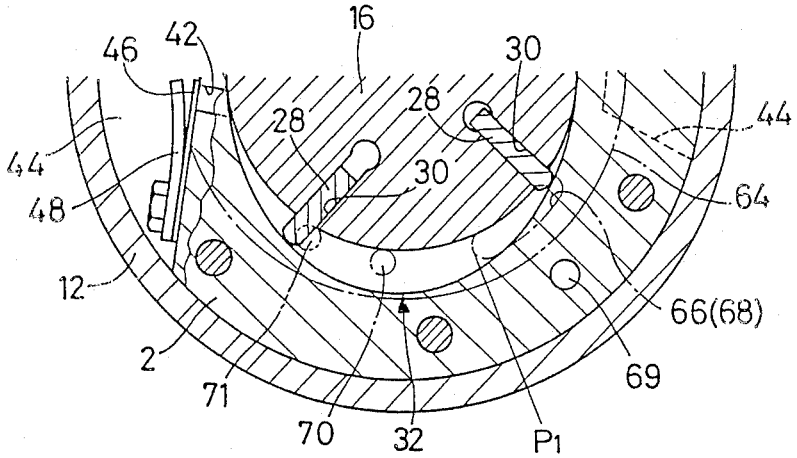
FIGS. 5, 6 and 7 are fragmentary elevational views in transverse cross section of the compressor of FIG. 1, showing different operating positions of the compressor.

The drive shaft 18 of the compressor is connected to an engine of the vehicle via an electromagnetic clutch (not shown). While the compressor is under a high cooling load and required to provide a relatively large delivery of the compressed refrigerant, the suction pressure of the refrigerant is relatively high. In this condition, the piston 102 of FIG. 4 is held in its retracted position with the refrigerant suction pressure overcoming the biasing force of the spring 106 and the atmospheric pressure. In this position, the valve member 98 is seated on the valve seat 100 and the communication passage 92 is closed by the valve member 98. Meantime, the oil in the lower part of the oil separator chamber 52 is fed to the first chamber 84 of the piston chamber 80 shown in FIG. 3, via the oil passage 56, vane slots 30, oil groove 60, etc. The oil pressure in the first chamber 84 holds the piston 76 in the position of FIG. 3, against the biasing force of the spring 88. In this position, the first and second holes 66 and 68 are perfectly aligned with each other, having a maximum area of communication therebetween, while the first and second relief holes 70 and 71 are distant from each other and not in communication, as illustrated in FIGS. 5 and 8. Further, the discharge-side edge or extremity of each first hole 66 is loacted at position P1 which is the most distant from the discharge port 42 in the direction of rotation of the rotor 16. In these conditions, there is substantially no flow restriction at the connection of the first and second holes 66, 68. The volume of the compression chamber 32 defined by the two adjacent vanes 28 is increased to its maximum level immediately before the trailing vane 28 has passed the discharge-side edge position P1 of the first hole 66. Since the compression of the refrigerant in the compression chamber 32 is started at this position P1, the compressor is operated to provide its maximum delivery, i.e., operated at its maximum or 100-capacity rating.

With the compressor kept operated in this full capacity condition, the room temperature of the vehicle is gradually lowered down to an intended comfortable level, and thus the cooling load to be applied to the compressor is reduced. As a result, an expansion valve disposed on the discharge side of an evaporator in the air-conditioning system is operated toward its closed position, and consequently the suction pressure of the refrigerant in the suction chamber 34 is lowered, whereby the piston 102 of FIG. 4 is advanced by the biasing force of the spring 106 and the atmospheric pressure. Thus, the valve member 98 is moved by the piston 102 away from the valve seat 100, and the communication passage 92 is opened. Accordingly, the refrigerant in the compressing compression chamber 32 is fed through the communication passage 92 into the second chamber 86 of the piston chamber 80 of FIG. 3. The refrigerant pressure acting on the second pressure-receiving surface 94 of the piston 76 causes the piston 76 to move toward the first chamber 84. As the piston 76 is moved toward the first chamber 84, the oil in the first chamber 84 is discharged toward the rotor 16. However, the narrow oil passage prevents the oil from being discharged at a high rate, namely, the oil passage serves as an oil damper which permits the piston 76 to be moved at a comparatively slow rate toward the first chamber 84.

Figure 6:
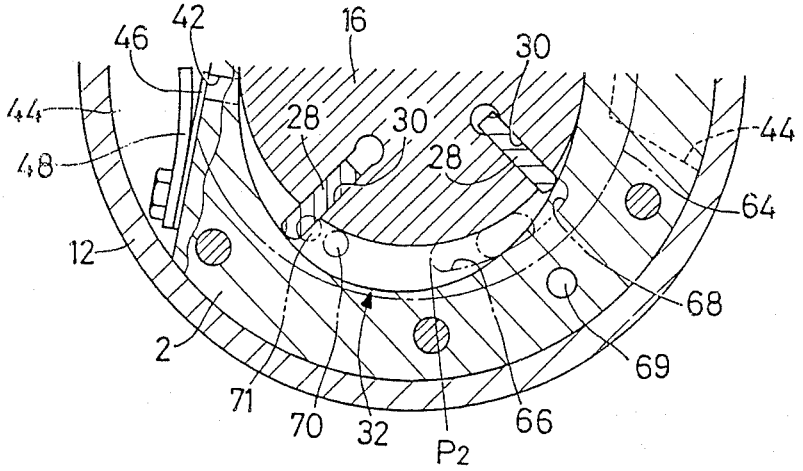

The piston 76 moving toward the first chamber 84 will cause the rotary plate 64 to be rotated in the clockwise direction as seen in FIG. 3, to the position of FIGS. 6 and 9 wherein the first relief hole 70 is located close to but not in communication with the second relief hole 71, while the first hole 66 is shifted toward the discharge port 42 is reduce the area of communication between the first and second hole 66, 68, and thereby restrict the suction flow of the refrigerant into the compression chamber 32. Furhter, since the discharge-side extremity or edge of the first hole 66 is shifted to position P2 which is nearer to the discharge port 42 than the position P1, the compression start timing of the compression chamber 32 is accordingly retarded. Described more specifically, the suction flow of the refrigerant into the compression chamber 32 through the first and second holes 66, 68 is restricted, while at the same time the compression chamber 32 defined by the leading and trailing vanes 28 is not able to achieve effective compression of the refrigerant until the trailing vane 28 has passed the discharge-side edge position P2 of the first hole 66. Before the trailing vane 28 has passed the position P2, the relatively high-pressure leading compression chamber 32 defined by the above-indicated leading and trailing vanes 28 is in communication with the following relatively low-pressure compression chamber 32 through the by-pass holes 66 (first hole 66). As illustrated in FIG. 9, the high pressure refrigerant flows from the leading compressing compression chamber 32 into the following sucking compression chamber 32, past the lateral end of the above-indicated trailing vane 28 while this vane 28 is moved over the by-pass hole 66. Thus, the delivery of the compressor is reduced due to combined effects of the retardation of a timing of starting effective compression in the compression chamber 32, and the restriction of the suction flow of the refrigerant into the compression chamber 32. The reduction in the delivery will cause a reduction in amount of suction of the refrigerant into the compressor, which results in an increase in the refrigerant suction pressure. When the suction pressure has been raised to a level that overcomes the biasing force of the spring 106 and the atmospheric pressure, the piston 102 of the switch valve 96 of FIG. 4 is retracted, permitting the valve member 98 to be seated on the valve seat 100. As a result, the communication passage 92 is closed to cease the supply of the refrigerant from the compressing compression chamber 32 to the second chamber 86. Consequently, the piston 76 will not be moved toward the first chamber 84 any more, and held between the first and second chambers 84, 86, whereby the rotary plate 64 is held in the position of FIGS. 6 and 9. In this position, the compressor is operated to provide an intermediate delivery, i.e., operated at its intermediate capacity rating.

When the cooling load applied to the compressor (thermal load applied to the cooling circuit of the air-conditioning system) has been considerably lowered and the suction pressure of the refrigerant has been reduced below a given limit, the biasing force of the spring 106 and the atmospheric pressure hold the piston 102 in its advanced position for a comparatively long time, maintaining the valve member 98 away from the valve seat 100. Accordingly, the switch valve 96 is held open for a long time, and a sufficient amount of the refrigerant is supplied from the compressing compression chamber 32 to the second chamber 86 through the communication passage 92.

Figure 7:
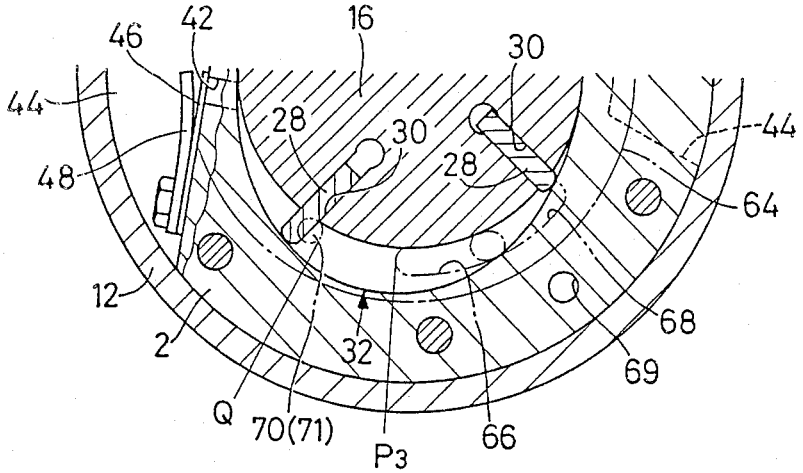
Figure 10:
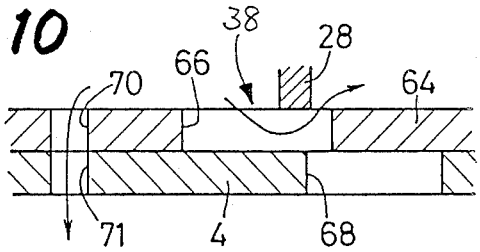

Accordingly, the piston 76 is moved to the end of the first chamber 84, whereby the rotary plate 64 is rotated the maximum angle to the position of FIGS. 7 and 10. In this position, the area of communication between the first and second holes 66 and 68 is further reduced, and the discharge-side extremity of the first hole 66 is shifted to position P3 which is nearest to the discharge port 42. Further, the first relief hole 70 is brought into full communication with the second relief hole 71. Therefore, the suction flow of the refrigerant is further reduced, and the compression start timing of the compression chamber 32 is further retarded (the effective compression is initiated at the position P3). In addition, the communicating first and second relief holes 70 and 71 permit the refrigerant in the compressing compression chamber 32 to be released into the suction chamber 34. Described in more detail, the communicating relief holes 70, 71 are located at position Q between the position P3 and the discharge ports 42 as viewed in the rotating direction of the rotor 16. Hence, the effective compression of the refrigerant in the leading compression chamber 32 will not be started until the vane 28 has passed the position Q. Thus, the compression start timing is further retarded. In this condition, the compressor is operated at its minimum capacity rating, i.e., protected from working more than necessary for satisfying the current cooling requirement. Hence, the load applied to the engine of the vehicle is reduced.

While the compressor is operated at a relatively low speed, the suction flow restriction by means of a reduced area of communication beween the first and second holes 66, 68 will not have a large effect on the reduction of the delivery of the compressor. However, the delivery of the compressor may be reduced to an appreciably effective extent by the refrigerant flow from the leading high-pressure compressing compression chamber 32 into the trailing low-pressure sucking compression chamber 32 past the lateral end of the vane 28, and by the release of the refrigerant from the compressing compression chamber 32 into the suction chamber 34 through the pressure relief passage, i.e., through the communicating first and second relief holes 70, 71. On the other hand, while the compressor is operated at a relatively high speed, the suction flow restriction will have a large effect on the reduction of the compressor delivery. Further, the amount of the refrigerant sucked into the compression chambers 32 is relatively small during the high-speed operation of the compressor. This permits a relatively easy flow of the refrigerant from the leading compression chamber 32 into the following compression chamber 32 past the lateral end of the vane 28 while the vane 28 between the two compression chambers 32 is moved over the first hole 66. In addition, the refrigerant under compression in the leading compression chamber 32 is easily released into the suction chamber 34 through the communicating first and second relief holes 70, 71. Thus, the refrigerant flow past the lateral end of the vane 28, and the release of the refrigerant into the suction chamber 34 have comparatively large effects on the reduction of the compressor delivery even while the compressor is operated at a high speed. The delivery of the compressor is gradually decreased from its maximum level obtained in the position of FIG. 5, down to its minimum level obtained in the position of FIG. 7 in which the first and second relief holes 70, 71 communicate with each other to define the pressure relief passage.

With the compressor operated continuously at the minimum capacity rating, the cooling load is increased and the refrigerant suction pressure is elevated, whereby the piston 102 is retracted to permit the valve member 98 to be seated on the valve seat 100 and thereby close the communication passage 92. As a result, the piston 76 of FIG. 3 is moved toward the second chamber 86, for intermediate or maximum capacity operation of the compressor. Subsequently, the compressor is operated at the maximum, intermediate or minimum capacity rating, according to a variation in the cooling load applied.

When the compressor is stopped, the oil in the first chamber 84 leaks into the compression chambers 32 through gaps between the rotor 16, and the front and rear side plates 4, 6, and the oil pressure in the first chamber 84 becomes equal to the suction pressure in the suction chamber 34. In the meantime, the refrigerant in the second chamber 86 is fed back into the compression chmabers 32 via the communication passage 92, and the pressure in the second chamber 86 becomes equal to the suction pressure in the suction chamber 34. Consequently, the piston 76 is moved by the biasing force of the spring 88 to the position on the side of the first chamber 84. Thus, the compressore is adapted to start in its minimum capacity position, for smooth rise of the engine load and reduced shock to the engine, and for avoiding compression of the refrigerant in the liquid state when the compressor is started.

Figure 11:
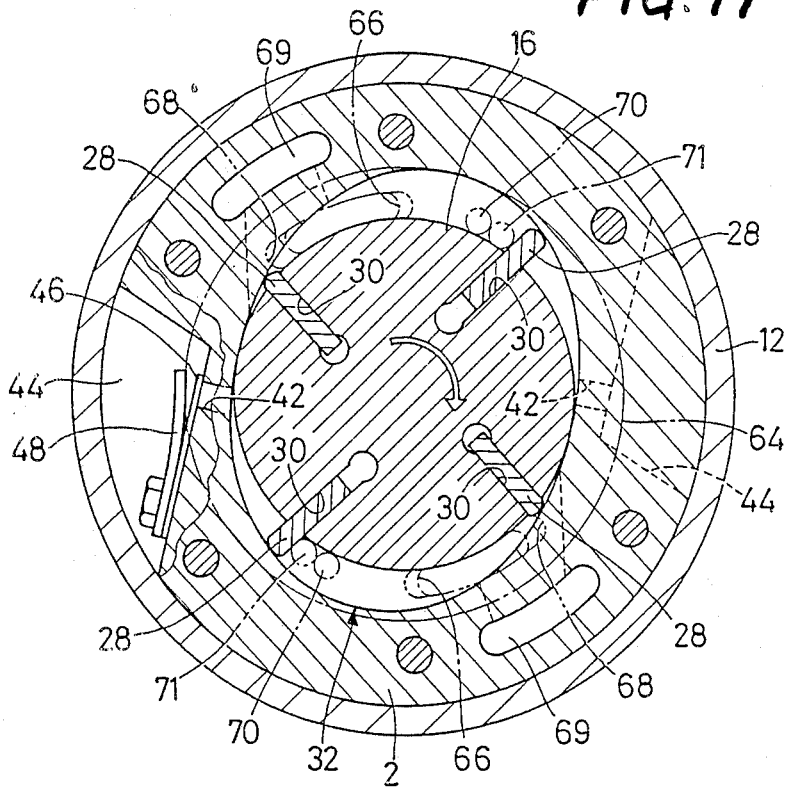
FIG. 11 is an elevational view in transverse cross section of another embodiment of the rotary vane type refrigerant compressor of the invention.
Figure 12:
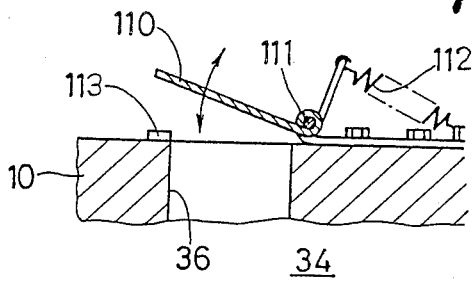
FIG. 12 is a fragmentary cross sectional view showing a part of the compressor of FIG. 11.

Referring next to FIGS. 11 and 12, another embodiment of the invention will be described.

In this modified embodiment, each of the second holes 68 formed in the front side plate 4 has a larger length than the first hole 66 formed in the rotary plate 64. With this arrangement, a rotary movement of the rotary plate 64 will not cause a change in the area of communication between the first and second holes 66, 68. Namely, the communication area is determined substantially by the area of the opening of the first hole 66, and the rotary plate 64 does not serve to restrict the suction flow of the refrigerant into the compression chamber 32. Instead, a variable flow restrictor device is provided, as shown in FIG. 12, to change the area of the opening of the refrigerant inlet 36 on the side opposite to the suction chamber 34, for changing the flow of the refrigerant through the inlet 36 into the suction chamber 34. This variable flow restrictor device comprises a restrictor valve in the form of a restrictor plate 110 having a surface area enough to cover the opening of the inlet 36. The restrictor plate 110 is supported on the front housing 10 pivotally about a shaft 111, and biased by a spring 112 in a direction that will cause the restrictor plate 110 to increase the effective opening area of the inlet 36. The dynamic pressure of the refrigerant flowing through a conduit (not shown) connected to the inlet 36 acts on the restrictor plate 110 in a direction that will cause the restrictor valve plate 110 to close the opening of the inlet 36. However, a stop 113 is provided on the front housing 10 to prevent a complete closure of the inlet 36 by the restrictor plate 110.

When the rotating speed of the rotor 16 of the compressor is increased as a result of an increase in the engine speed of the vehicle, the rate of flow of the refrigerant through the inlet 36 into the suction chamber 34 is increased and the dynamic pressure acting on the flow restrictor 110 is elevated. Accordingly, the restrictor plate 110 is pivoted in the direction to close the opening of the inlet 36, and the suction flow of the refrigerant into the compressor is reduced, whereby the delivery of the compressor is reduced accordingly.

Other parts of the compressor in this embodiment are the same as those of the preceding embodiment. For easy understanding, the same reference numerals as used in the preceding embodiment are used in FIGS. 11 and 12 to identify the corresponding components. While the preceding embodiment uses a variable flow restrictor device to restrict the refrigerant flow from the suction chamber 34 into the compression chamber 32, the variable flow restrictor device used in this modified embodiment is adapted to restrict the suction flow of the refrigerant into the suction chamber 34. This latter type of restrictor device provide the following advantages over the device of the preceding embodiment. In the case where the flow of the refrigerant between the suction chamber 34 and the compression chamber 32 is restricted as in the preceding embodiment, the pressure in the compression chamber 32 tends to be lower than that in the suction chamber 34 when the delivery is reduced while in a high-speed operation of the compressor. This means that there is a possibility of the compression chamber 32 sucking the refrigerant from the suction chamber 34 through the first and second holes 66, 68 even while the volume of the compression chamber 32 is being reduced. In the instant embodiment, however, the refrigerant is allowed to more smoothly flow from the leading high-pressure compression chamber 32 into the following low-pressure compression chamber 32 past the vane 28 while the volume of the leading compression chamber 32 is being reduced.

In the above two embodiments, it is possible that the first chamber 84 of the piston chamber 80 is connected to the compression chamber 32 to apply the pressure of the refrigerant under compression to the first pressure-receiving surface 90 of the piston 76, while the second chamber 86 is connected to the suction chamber 34 to apply the refrigerant suction pressure to the second pressure-receiving surface 94 of the piston 76. In this instance, the piston 76 is moved toward the second chamber 86 against the biasing force of the spring 88 by a pressure differential between the pressure of the refrigerant in the compressing compression chamber 32, and the pressure in the suction chamber 34, as the cooling load applied to the compressor is increased. With the cooling load held above a given level, the piston 76 is held in the position on the side of the second chamber 86, whereby the compressor is operated at its maximum capacity rating. As the cooling load is reduced, the pressure differential is also reduced and the piston 76 is moved toward the first chamber 84 to a position at which the biasing force of the spring 88 is equal to the pressure differential. Accordingly, the rotary plate 64 is rotated to the corresponding intermediate capacity or minimum capacity position, depending upon the magnitude of the pressure differential between the first and second chambers 84, 86.

Figure 13:
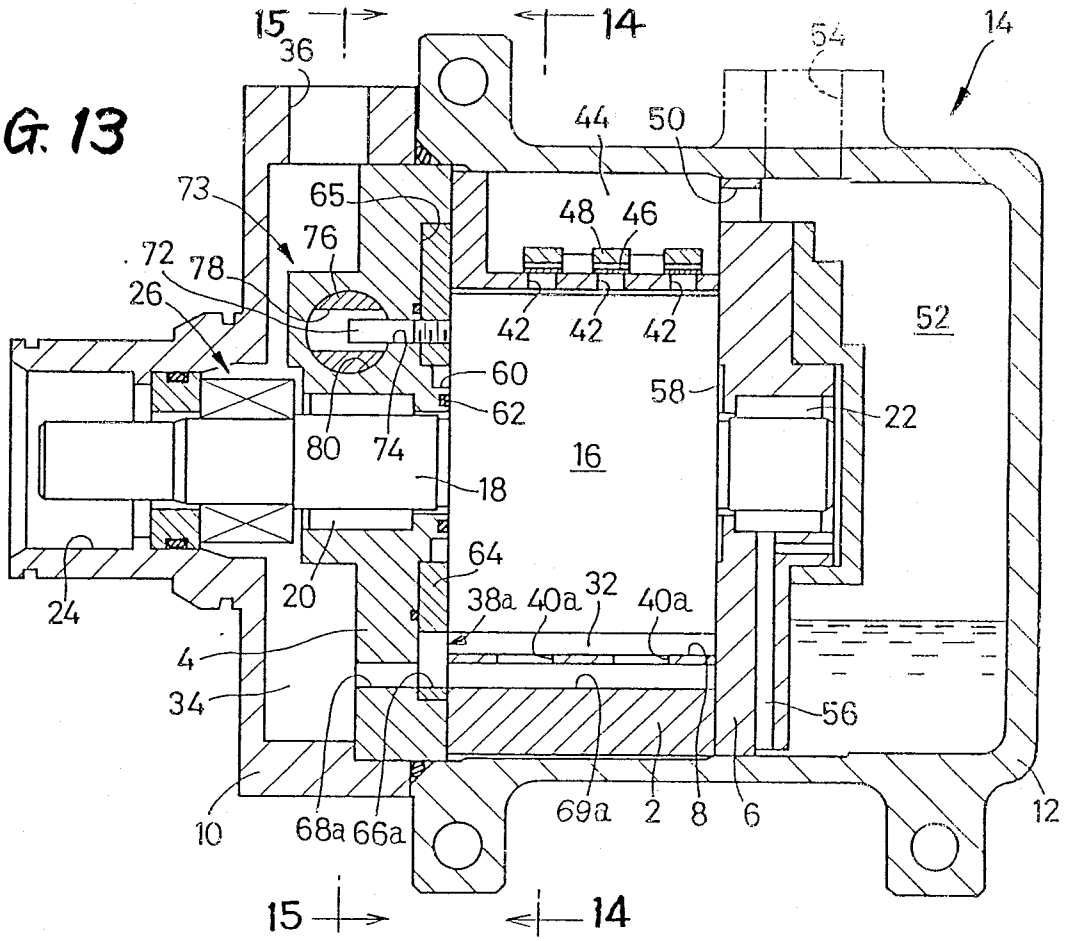
FIGS. 13, 14 and 15 are views corresponding to FIGS. 1, 2 and 3, showing a further embodiment of the invention.
Figure 14:
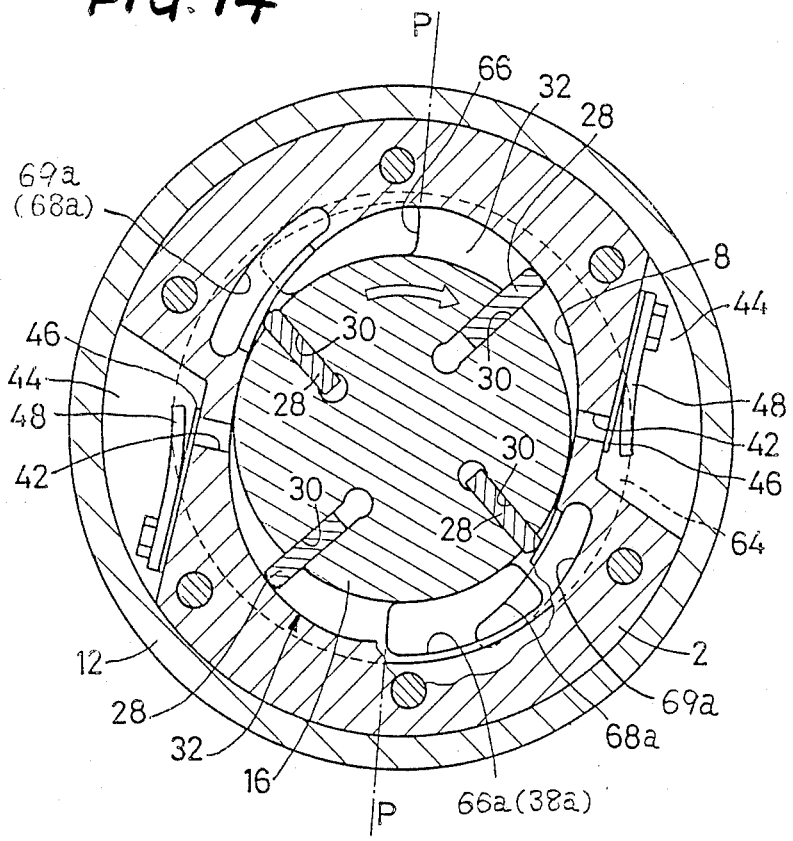

Referring to FIGS. 13–14, a further modified embodiment of the invention will described. For convenience, the same reference numerals as used in the preceding figures are used in FIGS. 13–14 to identify the corresponding components. However, small letters such as "a" and "b" are used following the reference numerals, to indicate those elements of the present embodiment which differ from the corresponding elements in terms of size, configuration, location or function.

The modified embodiment of FIGS. 13–14 is similar to the first embodiment of FIGS. 1–4, but is not provided with a pressure relief device for releasing the pressure of the refrigerant under compression in the compression chamber 32. Namely, the first and second relief holes 70, 71 are not formed in the rotary plate 64 and front side plate 4. The absence of the pressure relief device is a major difference from the first embodiment. Although the position of the reciprocating-piston actuator of FIG. 15 relative to the drive shaft 18 is reversed with respect to that of the actuator of FIG. 3, there is no substantive difference between these devices, since the rotating directions of the rotor 16 as viewed in these figures are reversed to each other.

Further, the arrangement for retarding the compression start timing and the variable flow restrictor device used in the present embodiment are different in some respects from those of the first embodiment of FIGS. 1–4. As will be apparent from FIGS. 14 and 15, the first holes 66*a* formed in the rotary plate 64 serve as the primary suction ports 38*a* open in the compression chambers 32. Further, the first holes 66*a* serve as passages for communication between the second holes 68*a* in the front side plate 4, and the auxiliary suction passages 69*a* in the cylinder 2. In this arrangement, therefore, a shift or displacement of the first hole 66*a* relative to the second hole 68*a* as indicated in FIG. 14 will restrict suction flows of the refrigerant into the compression chambers 32 not only through the primary suction port 38*a*, but also through the auxiliary suction passage 69*a* and the auxiliary suction ports 40*a*. Thus, the instant embodiment provides a greater degree of restriction of the suction flows into the compression chambers 32, than the first embodiment of FIGS. 1–4.

Figure 16:
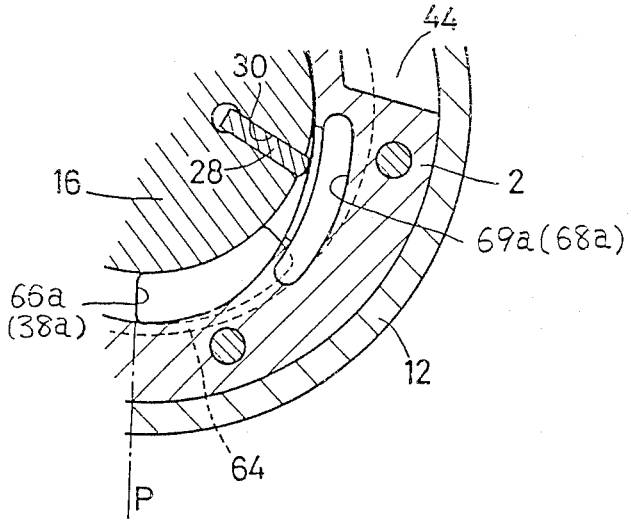
FIGS. 16 and 17 are fragmentary cross sectional views showing different operating positions of a rotary plate of the compressor of FIGS. 13–15.

While the compressor is at rest, the rotary plate 64 is placed in the position of FIG. 16 in which the first hole 66*a* is shifted a maximum distance from the second hole 68*a* toward the discharge port 42 in the rotating direction of the rotor 16. In this position, the maximum restriction of the suction flow is obtained. Further, the discharge-side extremity of the primary suction port 38*a* is located nearest to the discharge port 42. When the compressor is started in this condition, the amount of suction of the refrigerant into the compression chambers 32 is limited to the maximum extent, and the compression start timing is retarded in the maximum degree, whereby an abrupt increase in the engine load and compression of the refrigerant in a liquid state upn starting of the compressor are avoided.

Figure 17:
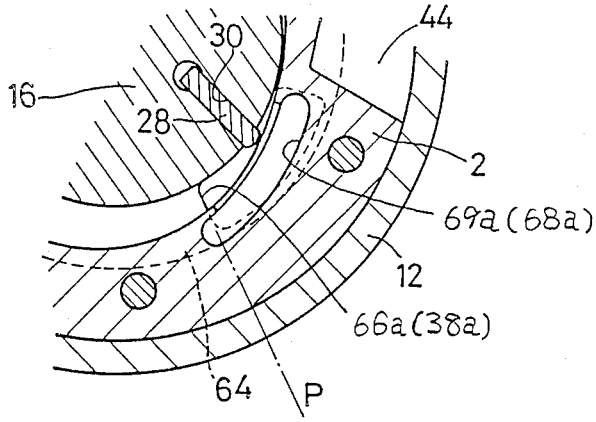

When the compressor is operated in a normal manner, the rotary plate 64 is rotated to the position of FIG. 17 in which the amount of shift or displacement of the first hole 66*a* relative to the second hole 68*a* is minimum. With the compressor operated in this condition, the cooling load is reduced and the suction pressure of the refrigerant is lowered. Consequently, the rotary plate 64 is rotated to the position of FIG. 14 or 16, for intermediate or minimum capacity operation.

Figure 18:
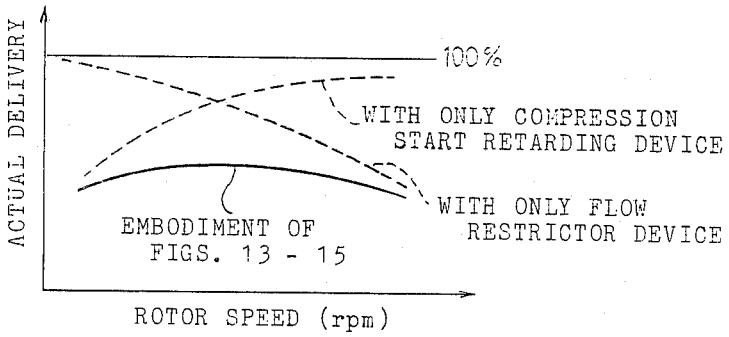
FIG. 18 is a graph representing a relation between the delivery and operating speed of the compressor of FIGS. 13–15.

FIG. 18 shows a relation between the actual delivery of the compressor and the rotating speed of the rotor 16 while the compressor is in the minimum capacity position. As indicated in broken lines, as the rotor speed is increased, the delivery reducing effect is decreased if only the compression timing retarding device is provided, but increased if only the variable flow restrictor device is provided. In the present embodiment which incorporates both the compression timing retarding device and the variable flow restrictor device, the delivery reducing effect is comparatively high and substantially uniform over the entire range of the rotor speed.

Figure 15:
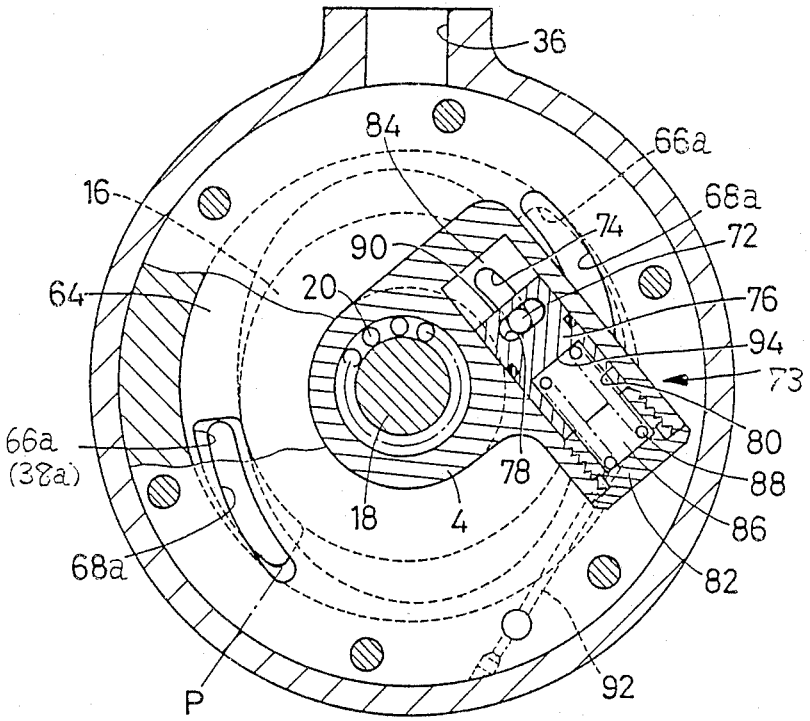
Figure 19:
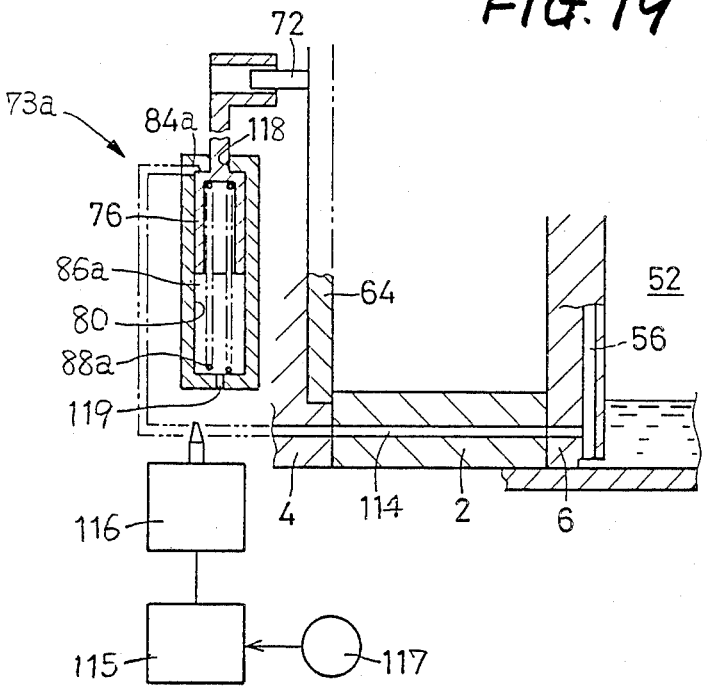
FIG. 19 is a schematic view illustrating an actuator device for rotating a rotary plate in a still further embodiment of the invention.

In the present embodiment, the rotary-plate actuator device is constituted by the reciprocating-piston actuator of FIG. 15 and the switch valve 96 of FIG. 4. It is possible to replace this type of actuator device with an actuator device as shown in FIG. 19. In this modified actuator device, the oil reserved in the lower part of the oil separator chamber 52 is fed to the first chamber 84*a* of the piston chamber 80 via an oil passage 114 which is formed in the rear side plate 6, cylinder 2 and front side plate 4. To open and close this oil passage 114, there is provided a solenoid valve 116 which is actuated under the control of a controller 115.

The controller 115 is connected to a pressure sensor 117 which generates a pressure signal indicative of the suction pressure in the suction chamber 34. While the cooling load is high and the suction pressure in the suction chamber 34 is higher than a preset level, the controller 115 keeps the solenoid valve 116 in its open position, to permit the refrigerant pressure to be applied to the first chamber 84*a* through the oil passage 114. In this condition, the piston 76 is placed in the position on the side of the second chamber 86*a*, resisting the biasing force of the spring 88*a*, whereby the rotary plate 64 is held in the maximum capacity position for maximum delivery of the compressor. As the cooling load is reduced, and the suction pressure of the refrigerant is lowered below the preset level, the pressure signal causes the controller 115 to actuate the solenoid valve 116 for closing the oil passage 114. As a result, the piston 76 is moved by the biasing force of the spring 88*a* toward the first chamber 84*a*. The oil in the first chamber 84*a* is discharged through a hole 118 into the suction chamber 34, and at the same time leaks into the second chamber 86*a* through a gap between the piston 76 and the piston chamber 80. The oil in the second chamber 86*a* is discharged through a relief hole 119 into the suction chamber 34. With the piston 76 moved toward the first chamber 84*a*, the rotary plate 76 is rotated toward its minimum capacity position.

It is possible to control the actuation time of the solenoid valve 116, i.e., its open and close time spans by changing the duty cycle of a drive current to be applied from the controller 112 to the solenoid valve 116, depending upon the suction pressure of the refrigerant. In this case, the rate of flow of the oil to a reciprocating actuator 73*a* through the oil passage 114 may be controlled to position the piston 76 at any positions between the above-indicated two stable positions, so that the delivery of the compressor may be adjusted continuously or steplessly according to a variation in the cooling load currently applied to the compressor.

Figure 20:
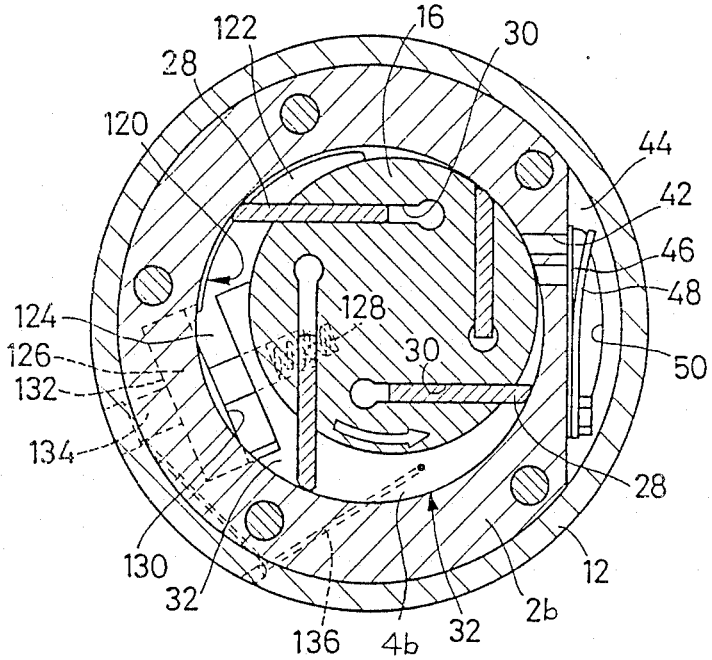
FIG. 20 is a transverse cross sectional view of a still another embodiment of the invention.
Figure 21:
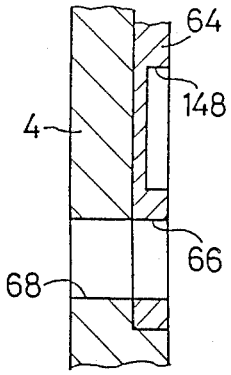
FIG. 21 is a fragmentary view showing yet another embodiment of the invention.

Referring to FIGS. 20 and 21, further modified embodiments of the invention will be described. In these figures, the same reference numerals as used in the preceding figures will be used to identify the corresponding components. However, smaller letter "b" is used to indicate those elements which are different from the corresponding elements of the preceding embodiments in terms of size, shape or function.

In the modified embodiment of FIG. 20, the rotor 16 is disposed eccentrically with the cylinder 2*b* so that the rotor 16 and the cylinder 2*b* are very close to each other at one point on the inner surface of the cylinder 2*b*, as viewed in transverse cross section. The discharge port 42 and a suction port 120 are provided on opposite sides of this point of the inner surface of the cylinder 2b. The suction port 120 is formed in the front side plate 4b, over a relatively long distance so as to assume a generally arcuate shape along the arc of the rotor 16. The arcuate section port 120 includes a first and a second suction portion 122, 124 which communicate with each other. The first suction portion 122 is located adjacent to the above-identified point on the inner surface of the cylinder 2, and the second suction portion 124 is located nearer to the discharge port 42 than the first suction portion 122 as viewed in the rotating direction of the rotor 16.

To fill the sapce of the second suction portion 124, a closure block 126 is supported in the front side plate 4b slidably in a direction perpendicular to the axis of rotation of the rotor 16. The closure block 126 is slidable between its advanced position in which the closure block 126 fills the second suction portion 124, and its retracted position in which the second suction portion 124 is left unoccupied by the closure block 126. A spring 128 is provided to bias the closure block 126 toward its retracted position. The closure block 126 is designed so that, when the block 126 is in the advanced position, its inner surface cooperates with portions of the inner surface of the front side plate 4b (in contact or close proximity to the end of the vane 28) to form a continuous surface in one plane.

The closure block 126 has a first pressure-receiving surface 130 on one side thereof opposite to the second suction portion 124, and a second pressure-receiving surface 132 on the other side. The second pressure-receiving surface 132 receives a pressure in a pressure chamber 134 which is formed in the front side plate 4b. This pressure chamber 134 is held in communication with the compression chamber 32 through a passage 136, so that the pressure of the refrigerant in the compressing compression chamber 32 is applied to the second pressure-receiving surface 132. On the other hand, the suction pressure in the second suction portion 124 acts on the first pressure-receiving surface 130. In this arrangement, the closure block 126 is moved between its advanced and retracted position, according to a difference between a force based on the pressure of the refrigerant under compression, and a sum of the biasing force of the spring 126 and a force based on the suction pressure. Thus, the means for exerting the pressures on the closure block 126 in the opposite directions constitutes an actuator for moving the closure block 126 between its two positions. The closure block 126 and its actuator constitute a device for changing the end or extremity of the suction port 120 on the side of the discharge port 42 as viewed in the rotating direction of the rotor 16. More specifically, the discharge-side extremity of the suction port 120 is changed depending upon whether the closure clock 126 is located in its advanced position or in its retracted position. The suction port 120, more particularly, its second suction portion 124 functions not only as a suction passage from which the refrigerant is sucked into the compression chamber 32, but also as a by-pass passage which permits the refrigerant in the leading relatively high-pressure compressing compression chamber 32 to flow into the following relatively low-pressure sucking compression chamber 32 past the lateral end of the vane 28. Namely, filling the second suction portion 124 of the suction port 120 with the closure block 126 results in changing the position of the discharge-side extremity of the opening of the by-pass passage. Therefore, the closure block 126 and its actuator constitute a device for changing the position of the discharge-size extremity of the by-pass passage, i.e., a by-pass position changing device.

The embodiment of FIG. 20 uses a variable flow restrictor device of the same type as that shown in FIG. 12, to change the effective area of opening of a suction passage communicating with the suction port 120.

In the compressor of FIG. 20 constructed as described above, while the cooling load is relatively high, the closure block 126 is moved to its advanced position by the pressure of the refrigerant under compression acting on the second pressure-receiving surface 132 of the closure block 126, whereby the second suction portion 124 of the suction port 120 is filled with the closure block 126. In this condition, the compressor is operated at its maximum capacity rating for maximum delivery.

As the cooling load is reduced and the suction pressure is lowered, the difference between the suction pressure and the pressure of the refrigerant under compression is reduced. This reduction in the pressure difference may be understood from the following equations:

Generally, when a gas of volume V1 of pressure P1 is compressed to volume V2, pressure P2 of the compressed gas of volume V2 is obtained as:

$$P2 = P1\ (V1/V2)^n$$

Therefore, a pressure difference ΔP between the pressures P1 and P2 is expressed by the following equation:

$$\Delta P = P2 - P1 = P1\ [(V1/V2)^n - 1]$$

This equation indicates that the pressure difference ΔP is reduced as the pressure P1 of the gas prior to the compression is lowered.

As the pressure difference between the pressures acting on the first and second pressure-receiving surfaces 130 and 132 of the closure block 126 is reduced to a given level, the closure block 126 is moved by the biasing force of the spring 128 to its retracted position away from the second suction portion 124. As a result, the discharge-side end of the suction port 120, i.e., the discharge-side extremity of the opening of the by-pass passage on the side of the compression chamber 32, is given by the discharge-side extremity of the second suction portion 124. Accordingly, the timing of starting effective compression in the compression chamber 32 is retarded due to the presence of the second suction portion 124, whereby the compressor is operated at its minimum capacity rating to provide its minimum delivery.

As the vehicle engine speed is increased and the compressor speed is accordingly raised, the variable flow restrictor device is operated to restrict the suction flow of the refrigerant into the compressor, and the delivery of the compressor is reduced to avoid excessive cooling of the passenger's room of the vehicle, thereby saving the required engine power and improving the drivability of the engine.

It is noted that the restriction of the suction flow of the refrigerant into the compressor is particularly effective in reducing the delivery of the compressor while the compressor is operating at a relatively high speed. On the other hand, the retardation of the compression start timing has a relatively large effect on the delivery reduction particularly while the compressor speed is relatively low. By utilizing these two features, it is possible to enable the compressor to operate at its minimum or reduced capacity rating, as needed, over the entire speed range.

In the case where the embodiment of FIGS. 1–4 or the embodiment of FIGS. 13–15 employs a variable flow restrictor device (as shown in FIG. 12) separate from the compression timing retarding device, it is possible to provide the rotary plate 64 with a by-pass passage in the form of an arcuate recess 148 as shown in FIG. 21, which does not communicate with the first hole 66 (66*a*) and which is located nearer to the discharge port 42 than the first hole 66 (66*a*) in the rotating direction of the rotor 16. This arcuate recess 148 is formed in the inner surface of the rotary plate 64 so that the recess 148 is open on the side of the rotor 16. The arcuate recess 148 has a relatively large arcuate length circumferentially of the cylinder 2, so as to permit the leading compression chamber 32 to communicate with the following compression chamber 32.

Figure 22:
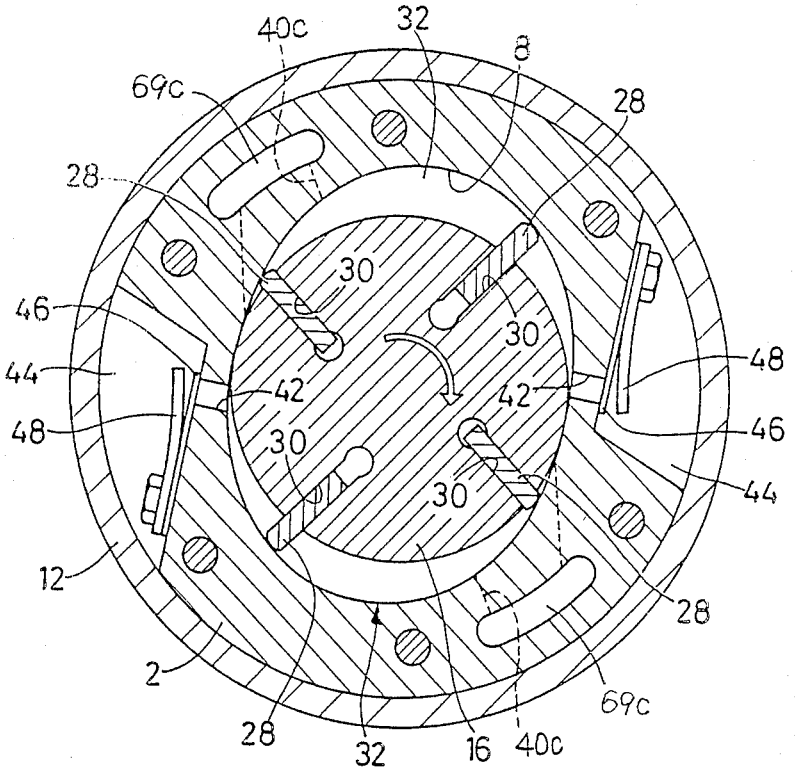
FIGS. 22 and 23 are views corresponding to FIGS. 2 and 3, showing a still further embodiment of the invention.
Figure 23:
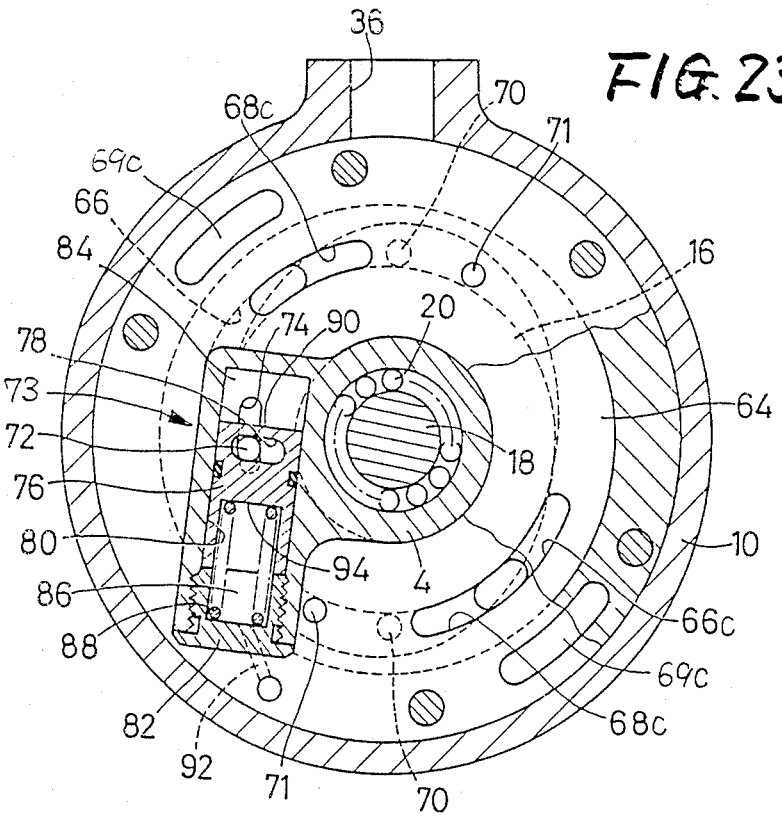

The modified embodiment of FIGS. 22 and 23 is identical with the embodiment of FIGS. 1–4, except that the variable flow restrictor device is not provided. Stated in more detail, the embodiment of FIGS. 22 and 23 has a suction port 40*c* which is larger than the auxiliary suction port 40 of the first embodiment of FIGS. 1–4. The suction of the refrigerant into the compression chamber 32 is achieved primarily through the suction port 40*c* and a suction passage 69*c*. Further, the front side plate 4 has a second hole 68*c* which is located nearer to the discharge port 42 in the rotating direction of the rotor 16, as compared with the second hole 68 of the first embodiment. This second hole 68*c* serves as a pressure relief passage for releasing the refrigerant from the compression chamber 32 into the suction chamber 34, rather than as a suction port. While the second hole 68*c* functions temporarily as a suction port, the compressore may operate without this function of the second hole 68*c*.

Figure 24:
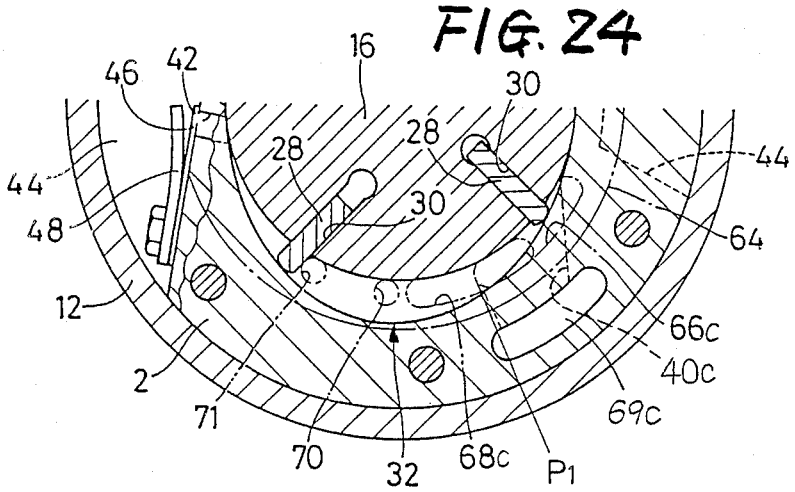
FIGS. 24, 25 and 26 are fragmentary views in transverse cross section of the compressor of FIGS. 22 and 23, showing different operating conditions of the compressor.
Figure 25:
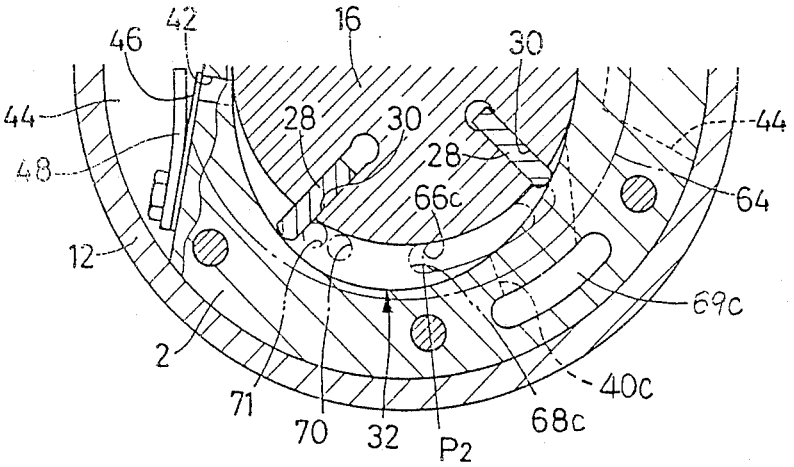
Figure 26:
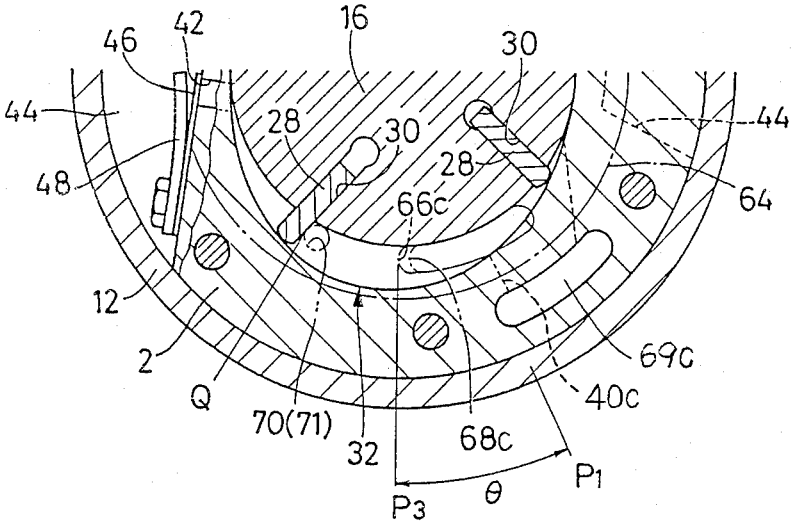

While the compressor is operated at its full capacity rating to provide its maximum delivery, the first hole 66*c* in the rotary plate 64 is located at a position most distant from the discharge port 42, as seen in FIG. 24. When the suction pressure of the refrigerant is lowered, the rotary plate 64 is rotated toward a position of FIG. 25, so that the first hole 66*c* is moved toward the discharge port 42. In the position of FIG. 25, the compressor is operated at its intermediate capacity rating. With the suction pressure further lowered, the rotary plate 64 is further rotated in the same direction toward a position of FIG. 26 in which the first relief hole 70 in the rotary plate 64 is aligned with the second relief hole 71. In this position, the first and second relief holes 70, 71 forms a pressure relief passage through which the refrigerant in the compressing compression chamber 32 is released into the suction chamber. In this condition, the compressor is operated at its minimum capacity rating.

As is apparent from the above description, the embodiment of FIGS. 22–26 is not provided with a variable flow restrictor device, but provided with a pressure relief device as well as a compression timing retarding device. The pressure relief device cooperates with the compression timing retarding device to enable the compressor to operate at its intermediate or minimum capacity rating, as needed, over the entire speed range. In the case where a variable flow restriction device is not provided, the recess 148 may be used as a by-pass passage.

In the illustrated embodiments, the piston 76 of the reciprocating-piston actuator 73, 73*a* (FIGS. 3, 15, 19 and 22) is operated by the reduced pressure of the oil from the oil-separator chamber 52 and the refrigerant pressure, it is possible to use pressures of the oil from the chamber 52 on both sides of the piston 76. For example, the communication passage 92 of the actuator 73 of FIG. 3 may be connected to the oil-separator chamber 52 so that the oil is introduced to the second chamber 86 with only a small degree of pressure drop. Further, it is possible to use a rack-and-pinion arrangement or a stepper motor for driving the rotary plate 64. In the case of the rack-and-pinion arrangement, a rack is fixed to a reciprocating piston while a pinion is secured to the rotary plate 64 so that the pinion meshes with the rack. While the present invention has been described in its preferred embodiments in the form of rotary refrigerant compressors of vane type, it is to be understood that the principle and concept of the present invention are applicable to other types of a rotary compressor for compressing gases other than a refrigerant. For example, the invention may be embodied as a compressor of a type wherein a rotor rotates in sliding contact with the inner surface of a cylinder, about an axis eccentric with the cylinder, such that the center of the rotor rotates along a circle concentric with the cylinder.

It will be obvious to those skilled in the art that other changes, modifications and improvements may be made in the invention, in the light of the foregoing teachings, without departing from the scope of the invention defined in the appended claims.

What is claimed is:

1. A variable-delivery compressor having a rotor rotatable in a housing and a plurality of compression chambers whose volume is changed as the rotor is rotated to compress a gas sucked from a suction chamber through a suction port and to deliver the compressed gas through a discharge port, said compressor comprising:

a movable member movably supported in said housing and having a movable member hole formed therethrough not only as a by-pass passage for communication between a compressing compression chamber of said compression chambers which is compressing the gas, and a sucking compression chamber of said compression chambers which is sucking the gas, but also as part of a variable flow restrictor device;

a stationary member having a stationary member hole formed therethrough in communication with said hole in said movable member, and with said suction port communicating with said suction chamber;

an actuator device for moving said movable member relative to said stationary member, thereby changing the position of one of opposite extremities of said by-pass passage located nearer to said discharge port than the other extremity in the rotating direction of said rotor, whereby said movable member and said actuator device with each other to constitute a compression timing retarding device for retarding a timing at which effective compression of said gas is started in said compressing compression chamber;

said actuator devicd being also operable for changing the position of said movable member hole relative to said stationary member hole, whereby said movable member, said actuator device and said stationary member cooperate to constitute said variable flow restrictor for changing an area of communication between said movable member hole and stationary member hole and thereby adjusting a flow of the gas which is sucked through said suction port into said compression chambers, wherein said movable member further has a movable member relief hole formed therethrough, said movable member relief hole being located nearer to said discharge port than said movable member hole in said rotating direction of the rotor, an opening of said movable member relief hole being dimensioned so as not to allow said compressing compression chamber to communicate with said sucking compression chamber through said opening of the movable member relief hole, said stationary member further having a stationary member relief hole formed therethrough, said stationary member relief hole being located at a position nearer to said discharge port than said one extremity of said by-pass passage so that the stationary member relief hole does not normally communicate with said movable member relief hole, said movable member relief hole being brought into communication with said stationary member relief hole for releasing a portion of said gas from said compressing compression chamber into said suction chamber when said one extremity of said by-pass passage has been shifted to a position nearest to said discharge port upon movement of said movable member by said actuator device, whereby said movable member relief hole and stationary member relief hole cooperate to constitute a pressure relief passage which is opened and closed by said actuator device.

2. A variable-delivery compressor having a rotor rotatable in a housing and a plurality of compression chambers whose volume is changed as the rotor is rotated to compress a gas sucked from a suction chamber through a suction port and to deliver the compressed gas through a discharge port, said compressor comprising:

a movable member movably supported in said housing an having a by-pass passage for communication between a compressing compression chamber of said compression chambers which is compressing the gas, and a sucking compression chamber of said compression chambers which is sucking the gas;

said movable member further having a movable member relief hole formed through its thickness at a position nearer to said discharge port than said by-pass passage in the rotating direction of said rotor, an opening of said movable member relief hole being dimensioned so as not to allow said compressing compression chamber to communicate with said sucking compression chamber through said opening of the movable member relief hole;

a stationary member having a stationary member relief hole formed therethrough, said stationary member relief hole being located at a position nearer to said discharge port than said by-pass passage, such that said stationary member relief hole does not normally communicate with said movable member relief hole;

an actuator device for moving said movable member relative to said stationary member, thereby changing the position of one of opposite extremities of said by-pass passage located nearer to said discharge port than the other extremity in the rotating direction of said rotor, whereby said movable member and said actuator device cooperate with each other to constitute a compression timing retarding device for retarding a timing at which effective compression of said gas is started in said compressing compression chamber;

said actuator device being also operable for changing the position of said movable member relief hole relative to said stationary member relief hole, for bringing said movable member relief hole into communication with said stationary member relief hole for releasing a portion of said gas from said compressing compression chamber into said suction chamber when said one extremity of said by-pass passage has been shifted to a position nearest to said discharge port, whereby said movable member relief hole and said stationary member relief hole cooperate to constitute a pressure relief passage which is opened and closed by said actuator device.

3. A variable-delivery compressor having a housing including a cylinder and a side plate, and (b) a rotor rotatable in said housing and having vanes which slidably contact an inner surface of said cylinder, said rotor cooperating with said housing to define a plurality of compression chambers whose volume is changed as the rotor is rotated to compress a gas sucked from a suction chamber through a suction port and to deliver the compressed gas through a discharge port, said compressor comprising:

a rotary plate disposed between said cylinder and said side plate and supported rotatably substantially about an axis of said cylinder such that an inner surface of said rotary plate is substantially in contact with end surfaces of said rotor and said vanes, said rotary plate having a rotary plate hole formed through its thickness not only as a by-pass passage for communication between a compressing compression chamber of said compression chambers which is compressing the gas, and a sucking compression chamber of said compression chambers which is sucking the gas, but also as part of a variable flow restrictor device;

said side plate having a side plate hole formed through its thickness in communication with said rotary plate hole and said suction chamber;

a rotary-plate actuator device for rotating said rotary plate relative to said side plate, thereby changing the position of one of opposite extremities of said by-pass passage located nearer to said discharge port than the other extremity in said rotating direction, whereby said rotary plate and said rotary-plate actuator device cooperate with each other to constitute a compression timing retarding device for retarding a timing at which effective compression of said gas is started in said compressing compression chamber;

said rotary-plate actuator device being also operable for changing the position of said rotary plate hole relative to said side plate hole, whereby said rotary plate, said rotary-plate actuator device and said side plate cooperating to constitute said variable flow restrictor for changing an area of communication between said rotary plate hole and side plate hole and thereby adjusting a flow of the gas which is sucked from said suction chamber into said sucking compression chamber;

said rotary plate further having a rotary plate relief hole formed through its thickness, said rotary plate relief hole being located nearer to said discharge port than said rotary plate hole in said rotating direction of the rotor, an opening of said rotary plate relief hole being dimensioned such that the opening is closed by a lateral end of said vanes; and said side plate further having a side plate relief hole formed through its thickness, said side plate relief hole being located at a position nearer to said discharge port than said one extremity of said by-pass passage so that the side plate relief hole does not normally communicate with said rotary plate relief hole, said rotary plate relief hole being brought into communication with said side plate relief hole for releasing a portion of said gas from said compressing compression chamber into said suction chamber when said one extremity of saib by-pass passage has been shifted to a position nearest to said discharge port upon rotation of said rotary plate by said rotary-plate actuator device, whereby said rotary plate relief hole and said side plate relief hole cooperate to constitute a pressure relief passage which is opened and closed by said rotary-plate actuator device.

4. A variable-delivery compressor according to claim 3, wherein said rotary-plate actuator device comprises:

an engaging portion provided on said rotary plate;

a reciprocating actuator engaging said engaging portion of the rotary plate, said reciprocating actuator being movable in a direction tangent to a circular path taken by said engaging portion of the rotary plate when the rotary plate is rotated; and a control valve for controlling a supply of a working fluid to said reciprocating actuator.

5. A variable-delivery compressor according to claim 4, wherein said reciprocating actuator comprises:

a cylinder housing secured to said side plate;

a piston slidably fitted in said cylinder housing and engaging said engaging portion of said rotary plate, said piston dividing a space in said cylinder housing into a first chamber and a second chamber;

a spring biasing said piston toward said first chamber;

an oil passage through which an oil in an oil separator chamber provided on the discharge side of the compressor is fed to said first chamber while a pressure of said oil is reduced during a flow of said oil to said first chamber; and a communication passage through which the gas compressed by the compressor to a pressure higher than that of said oil in said first chamber is fed to said second chamber via said control valve, said pressure relief passage being open when said rotary plate is rotated with a movement of said piston toward said first chamber.

6. A variable-delivery compressor according to claim 5, wherein said control valve comprises a valve seat provided in said communication passage, a valve member adapted to be seated on said valve seat, and a valve actuator for moving said valve member away from said valve seat to open said communication passage, said valve actuator including an actuator piston receiving a suction pressure of the gas, said actuator piston being retracted to permit said valve member to be seated on said valve seat when said suction pressure is relatively high, and advanced to force said valve member away from said valve seat when said suction pressure is relatively low.

* * * * *

UNITED STATES PATENT AND TRADEMARK OFFICE

CERTIFICATE OF CORRECTION

PATENT NO. : 4,726,740

DATED : February 23, 1988

INVENTOR(S) : S. Suzuki et al

It is certified that error appears in the above-identified patent and that said Letters Patent is hereby corrected as shown below:

Column 1, line 7, change "an" to --and--.

Column 1, line 62, change "assigneee" to --assignee--.

Column 2, line 2, delete "quotation mark" (") after "side".

Column 2, line 3, after "port" insert quotation mark --" --.

Column 4, line 10, "capcity" should read --capacity--.

Column 8, line 28, "iston" should read --piston--.

Column 8, line 35, "85" should read --84--.

Column 8, line 49, "chamer" should read "chamber--.

Column 11, line 10, "is reduce" should read --to reduce--.

Column 13, line 27, "compressore" should read --compressor --.

Column 17, line 14, "sapce" should read --space--.

Column 17, line 46, "126" should read --128--.

UNITED STATES PATENT AND TRADEMARK OFFICE

CERTIFICATE OF CORRECTION

PATENT NO. : 4,726,740

DATED : February 23, 1988

INVENTOR(S) : S. Suzuki et al

It is certified that error appears in the above-identified patent and that said Letters Patent is hereby corrected as shown below:

Column 20, line 66 "devicd" should read --device--.

Column 21, line 44, "an" should read --and--.

Column 22, line 23, after "having" insert --(a)--.

Column 23, line 21, "saib" should read --said--.

Signed and Sealed this

Fourteenth Day of February, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,726,740

DATED : February 23, 1988

INVENTOR(S) : S. Suzuki et al.

It is certified that error appears in the above-identified patent and that said Letters Patent is hereby corrected as shown below:

Column 20, line 61, after "device" the word --cooperate-- should be inserted.

Signed and Sealed this

Twelfth Day of December, 1989

*Attest:*

JEFFREY M. SAMUELS

*Attesting Officer* *Acting Commissioner of Patents and Trademarks*